US011744290B2

(12) United States Patent
Liu

(10) Patent No.: US 11,744,290 B2
(45) Date of Patent: Sep. 5, 2023

(54) ATOMIZER, E-CIGARETTE ASSEMBLY COMPRISING ATOMIZER, AND E-CIGARETTE COMPRISING E-CIGARETTE ASSEMBLY

(71) Applicant: Shenzhen Eigate Technology Co., Ltd., Shenzhen (CN)

(72) Inventor: Tuanfang Liu, Shenzhen (CN)

(73) Assignee: ASPIRE NORTH AMERICA LLC

( * ) Notice: Subject to any disclaimer, the term of this patent is extended or adjusted under 35 U.S.C. 154(b) by 349 days.

(21) Appl. No.: 17/315,348

(22) Filed: May 9, 2021

(65) Prior Publication Data

US 2022/0240583 A1 Aug. 4, 2022

(30) Foreign Application Priority Data

| | | |
|---|---|---|
| Jan. 29, 2021 | (CN) | 202120261465.8 |
| Mar. 11, 2021 | (CN) | 202110267442.2 |
| Mar. 11, 2021 | (CN) | 202120514393.3 |

(51) Int. Cl.

| | |
|---|---|
| ***A24F 13/00*** | (2006.01) |
| ***A24F 40/465*** | (2020.01) |
| ***A24F 40/485*** | (2020.01) |
| ***A24F 40/10*** | (2020.01) |
| ***A24F 40/57*** | (2020.01) |
| ***H05B 6/06*** | (2006.01) |
| ***H05B 6/10*** | (2006.01) |

(52) U.S. Cl.
CPC ..... *A24F 40/465* (2020.01); *A24F 40/10* (2020.01); *A24F 40/485* (2020.01); *A24F 40/57* (2020.01); *H05B 6/06* (2013.01); *H05B 6/108* (2013.01)

(58) Field of Classification Search
CPC ..... A24F 47/00
USPC ..... 131/328–329
See application file for complete search history.

(56) References Cited

U.S. PATENT DOCUMENTS

| | | | | |
|---|---|---|---|---|
| 2017/0164655 | A1* | 6/2017 | Chen | A24F 40/46 |
| 2022/0408822 | A1* | 12/2022 | Lee | A24F 40/51 |

* cited by examiner

*Primary Examiner* — Phuong K Dinh
(74) *Attorney, Agent, or Firm* — Matthias Scholl P.C.; Matthias Scholl

(57) ABSTRACT

The atomizer includes a housing, and an atomization assembly disposed in the housing. When in use, the atomizer is detachably connected to a high-frequency heater. The atomization assembly includes an atomizing core, a heating element, and a sleeve. The sleeve is connected to and enclosed by the housing, and a cavity is formed between the sleeve and the housing. The atomizing core and the heating element are fixedly disposed in the sleeve. The atomizing core includes a first surface and a second surface which are disposed back to back. The sleeve includes a main body through which e-liquid flows from the cavity into the sleeve and accumulates around the first surface of the atomizing core. The heating element is surrounded by the second surface of the atomizing core.

15 Claims, 10 Drawing Sheets

ATOMIZER, E-CIGARETTE ASSEMBLY COMPRISING ATOMIZER, AND E-CIGARETTE COMPRISING E-CIGARETTE ASSEMBLY

CROSS-REFERENCE TO RELATED APPLICATIONS

Pursuant to 35 U.S.C. § 119 and the Paris Convention Treaty, this application claims foreign priority to Chinese Patent Application No. 202110130270.4 filed Jan. 29, 2021, to Chinese Patent Application No. 202120261465.8 filed Jan. 29, 2021, to Chinese Patent Application No. 202110267442.2 filed Mar. 11, 2021, and to Chinese Patent Application No. 202120514393.3 filed Mar. 11, 2021. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND

The disclosure relates to the field of e-cigarette, and more particularly, to an atomizer, an e-cigarette assembly comprising the atomizer, and an e-cigarette comprising the e-cigarette assembly.

Conventional electronic cigarettes include an atomizer and a battery. The atomizer includes a heating element and an atomizing core for heat conduction. The heating element is directly powered by the battery and generates heat. The atomizing core transfers the heat to the e-liquid, so that the e-liquid is atomized to produce smoke for inhalation by user. However, the capacity of the battery is limited, resulting in low heating power, short service life, and a small amount of smoke. In addition, the e-liquid tends to leak, thus leading to short circuits of the battery.

In the prior art, an electromagnetically heated electronic cigarette includes an atomizer and an induction coil, which are fixed with each other. The electronic cigarette is bulky and inconvenient to carry. The induction coil is usually fixedly disposed around the atomizer. Once the atomizer breaks down or the e-liquid runs out, the e-cigarette will have to be thrown away instead of replacing the atomizer with a new one.

SUMMARY

In one aspect, the disclosure provides an atomizer. The atomizer comprises a housing, and an atomization assembly disposed in the housing. When in use, the atomizer is detachably connected to a high-frequency heater.

The atomization assembly comprises an atomizing core, a heating element, and a sleeve. The sleeve is connected to and enclosed by the housing, and a cavity is formed between the sleeve and the housing. The atomizing core and the heating element are fixedly disposed in the sleeve. The atomizing core comprises a first surface and a second surface which are disposed back to back. The sleeve comprises a main body through which e-liquid flows from the cavity into the sleeve and accumulates around the first surface of the atomizing core. The heating element is surrounded by the second surface of the atomizing core.

In a class of this embodiment, the atomizing core is in the shape of a hollow cylinder. The heating element is disposed in the atomizing core.

In a class of this embodiment, the cross-section of the atomizing core is circular, elliptical, triangular, quadrilateral, pentagonal, hexagonal, heptagonal, etc.

In a class of this embodiment, the heating element is in the shape of a hollow cylinder. The shape of the cross-section of the heating element is the same as that of the cross-section of the atomizing core.

In a class of this embodiment, the heating element comprises a plurality of first holes. The atomizing core further comprises a plurality of protrusions that respectively matches the plurality of first holes and is disposed on the second surface. The plurality of protrusions is inserted into the plurality of first holes so that the heating element is fixedly disposed on the atomizing core.

In a class of this embodiment, the main body comprises a plurality of second holes; and the main body is disposed correspondingly to the atomizing core.

In a class of this embodiment, the atomizing assembly further comprises a strip of cotton disposed between the main body and the atomizing core.

In a class of this embodiment, the sleeve further comprises a first end and a second end. The main body is disposed between the first end and the second end. The housing is connected to the first end. The atomization assembly further comprises a base comprising a plurality of air inlets. The plurality of air inlets allows external gas to enter the atomizer.

In a class of this embodiment, the sleeve further comprises a fixing part disposed between the second end and the main body. One end of the atomizing core is connected to the fixing part and the other end of the atomizing core is connected to the base.

In a class of this embodiment, the housing is detachably connected to the sleeve. The atomizer further comprises a first sealing ring disposed at the joint between the housing and the sleeve.

In a class of this embodiment, the housing comprises glass, non-metallic ceramics, crystal, or agate.

In a class of this embodiment, the atomizing core comprises a porous material.

The disclosure also provides an e-cigarette assembly comprising a mouthpiece and the atomizer, and the mouthpiece is detachably connected to the housing and the sleeve.

In a class of this embodiment, the e-cigarette assembly further comprises a second sealing ring disposed at the joint between the mouthpiece and the housing.

In a class of this embodiment, the e-cigarette assembly further comprises a third sealing ring disposed at the joint between the mouthpiece and the sleeve.

In another aspect, the disclosure provides an e-cigarette comprising a high-frequency heater and the e-cigarette assembly. The high-frequency heater comprises a through hole, a first opening, and a second opening. The first opening and the second opening are opposite to each other and communicate with the through hole. The e-cigarette assembly is detachably disposed in the through hole.

In a class of this embodiment, the high-frequency heater comprises an induction coil and a control circuit.

The disclosure provides an atomizer and the atomization assembly of the atomizer is disposed in the housing. The sleeve is connected to and enclosed by the housing, and a cavity is formed between the sleeve and the housing. The atomizer comprises the heating element and is disposed in the high-frequency heater. The high-frequency heater is powered on, which induces an alternating current that flows through an induction coil and thus causes an alternating magnetic field. The heating element of the atomizer is heated by the eddy currents generated by the varying alternating magnetic field. The atomizing core is configured to conduct heat and penetrate e-liquid. The sleeve comprises a main body through which e-liquid flows from the cavity into the sleeve and accumulates around the first surface of the atomizing core. The heating element is surrounded by the second surface of the atomizing core. The e-liquid is heated by the heating element and atomized into smoke at high temperature, indicating that the heating element can be heated directly by the eddy currents instead of using batteries. Compared to the batteries, the high-frequency heating increases the heating power, leading to rapid atomization of the e-liquid and an increase in the amount of smoke produced. In addition, the atomizer does not use batteries, which prevents a short circuit caused by e-liquid leakage. The atomizer does not use batteries, which prevents a short circuit caused by e-liquid leakage. The e-cigarette assembly and the high-frequency heater are separately disposed, which enables flexible use and convenient carrying of an e-cigarette.

Figure 1:
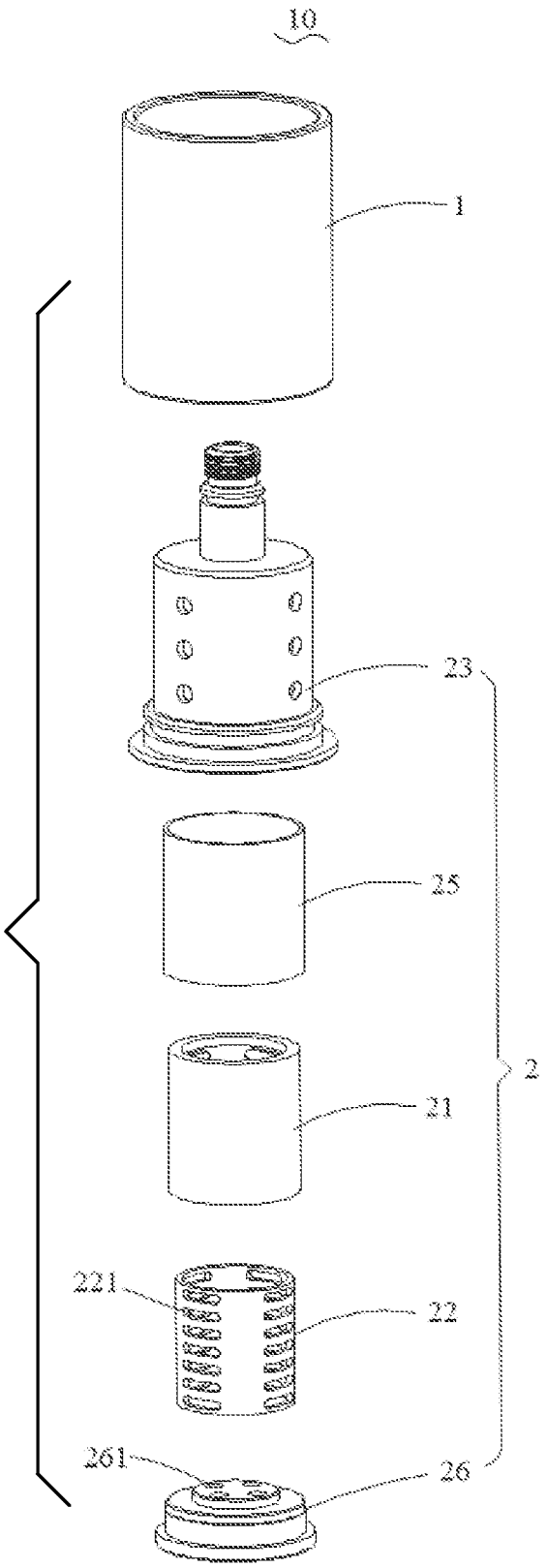
FIG. 1 is an exploded view of an atomizer according to one embodiment of the disclosure.

In the drawings, the following reference numbers are used: 1000. E-cigarette; 100. E-cigarette assembly; 10. Atomizer; 1. Housing; 2. Atomization assembly; 21. Atomizing core; 211. First surface; 212. Second surface; 213. Protrusion; 22. Heating element; 221. First hole; 23. Sleeve; 231. Main body; 2311. Second hole; 232. First end; 233. Second end; 234. Fixing part; 24. Cavity; 25. Cotton; 26. Base; 261. Air inlet; 3. First sealing ring; 20. Mouthpiece; 30. Second sealing ring; 40. Third sealing ring; 200. High-frequency heater; 201. Through hole; 202. First opening; and 203. Second opening.

DETAILED DESCRIPTION

To further illustrate the disclosure, embodiments detailing an atomizer, an e-cigarette assembly comprising the atomizer, and an e-cigarette comprising the e-cigarette assembly of the disclosure are described below. It should be noted that the following embodiments are intended to describe and not to limit the disclosure.

Figure 2:
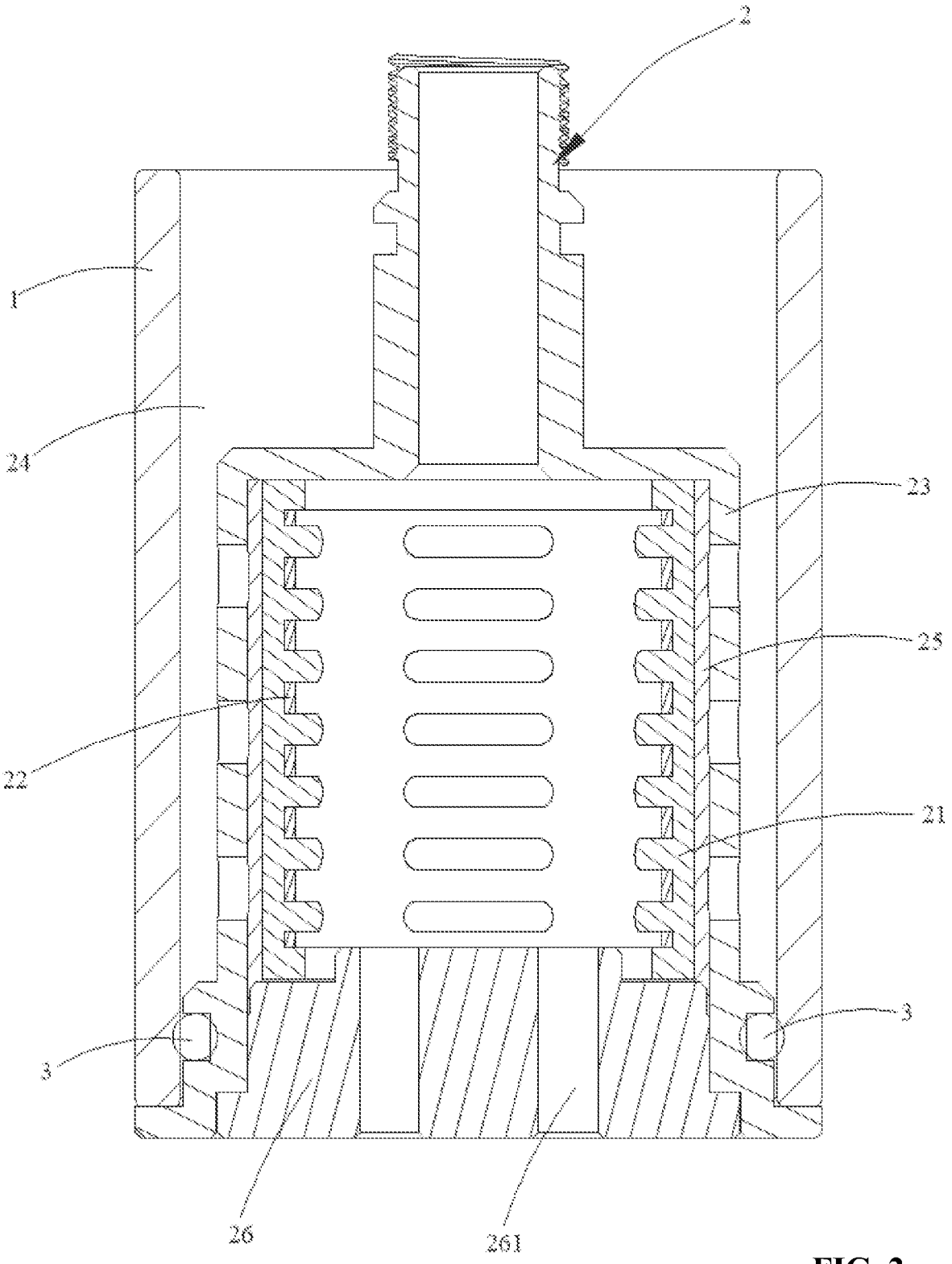
FIG. 2 is a cross section side view of an atomizer according to one embodiment of the disclosure.
Figure 3:
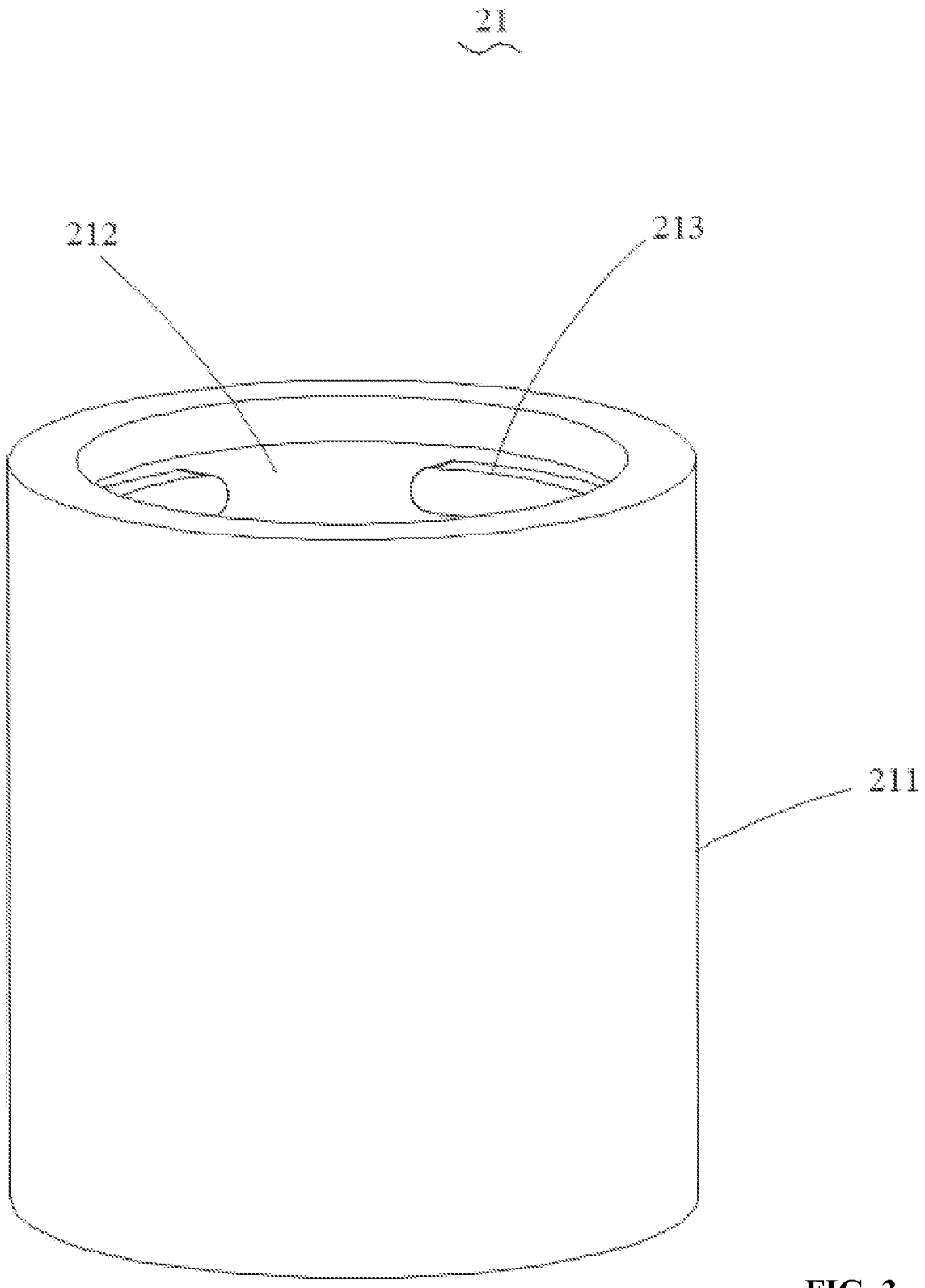
FIG. 3 is a schematic diagram of an atomizing core according to one embodiment of the disclosure.

Referring to FIGS. 1-3, the disclosure provides an atomizer 10 comprising a housing 1, and an atomization assembly 2 disposed in the housing 1. The atomization assembly 2 comprises an atomizing core 21, a heating element 22, and a sleeve 23. The sleeve 23 is connected to and enclosed by the housing 1, and a cavity is formed between the sleeve and the housing. Hereafter, the liquid storage area is called the cavity. The atomizing core 21 and the heating element 22 are fixedly disposed in the sleeve 23. The atomizing core 21 comprises a first surface 211 and a second surface 212, which are disposed back to back. The sleeve 23 comprises a main body 231 through which e-liquid flows from the cavity 24 into the sleeve 23 and accumulates around the first surface 211 of the atomizing core 21. The heating element 22 is surrounded by the second surface 212 of the atomizing core 21. The atomizer 10 is disposed in a high-frequency heater 200. The high-frequency heater 200 is powered on, which induces an alternating current that flows through an induction coil (not shown) and thus causes an alternating magnetic field. The heating element 22 of the atomizer 10 comprises metal which is heated by the eddy currents generated by the varying alternating magnetic field. The atomizing core 21 is configured to conduct heat and penetrate e-liquid. The e-liquid flows from the first surface 211 to the second surface 212 and accumulates around the heating element 22. The e-liquid is heated by the heating element 22 and atomized into smoke at high temperature, indicating that the heating element 22 can be heated directly by the eddy currents instead of using batteries. Compared to the batteries, the high-frequency heating increases the heating power, leading to rapid atomization of the e-liquid and an increase in the amount of smoke produced. In addition, the atomizer 10 does not use batteries, which prevents a short circuit caused by e-liquid leakage.

The sleeve 23 comprises a plastic material with high temperature resistance, or a non-metallic material. The atomizing core 21 comprises a porous material, including but not limited to ceramic cores, cotton cores, etc.

The atomizing core 21 is in the shape of a hollow cylinder. The heating element 22 is disposed in the atomizing core 21. The hollow cylinder increases the volume of the atomizing core 21, increases the amount of the e-liquid accumulating around the first surface 211 of the atomizing core 21, and therefore increases the amount of the smoke produced.

The cross-section of the atomizing core 21 is circular, elliptical, triangular, quadrilateral, pentagonal, hexagonal, heptagonal, etc.

The heating element 22 is in the shape of a hollow cylinder. The shape of the cross-section of the heating element 22 is the same as that of the cross-section of the atomizing core 21.

Referring to FIGS. 1 and 3, the heating element 22 comprises a plurality of first holes 221. The atomizing core 21 further comprises a plurality of protrusions 213 that respectively matches the plurality of first holes 221 and is disposed on the second surface 212. The plurality of protrusions 213 is inserted into the plurality of first holes so that the heating element 22 is fixedly disposed on the atomizing core 21. The e-liquid is passed through the second surface 212, heated by the heating element 22, and atomized into smoke at high temperature. The smoke produced flows to the first surface 211 through the plurality of first holes, and then is inhaled by a user.

Figure 4:
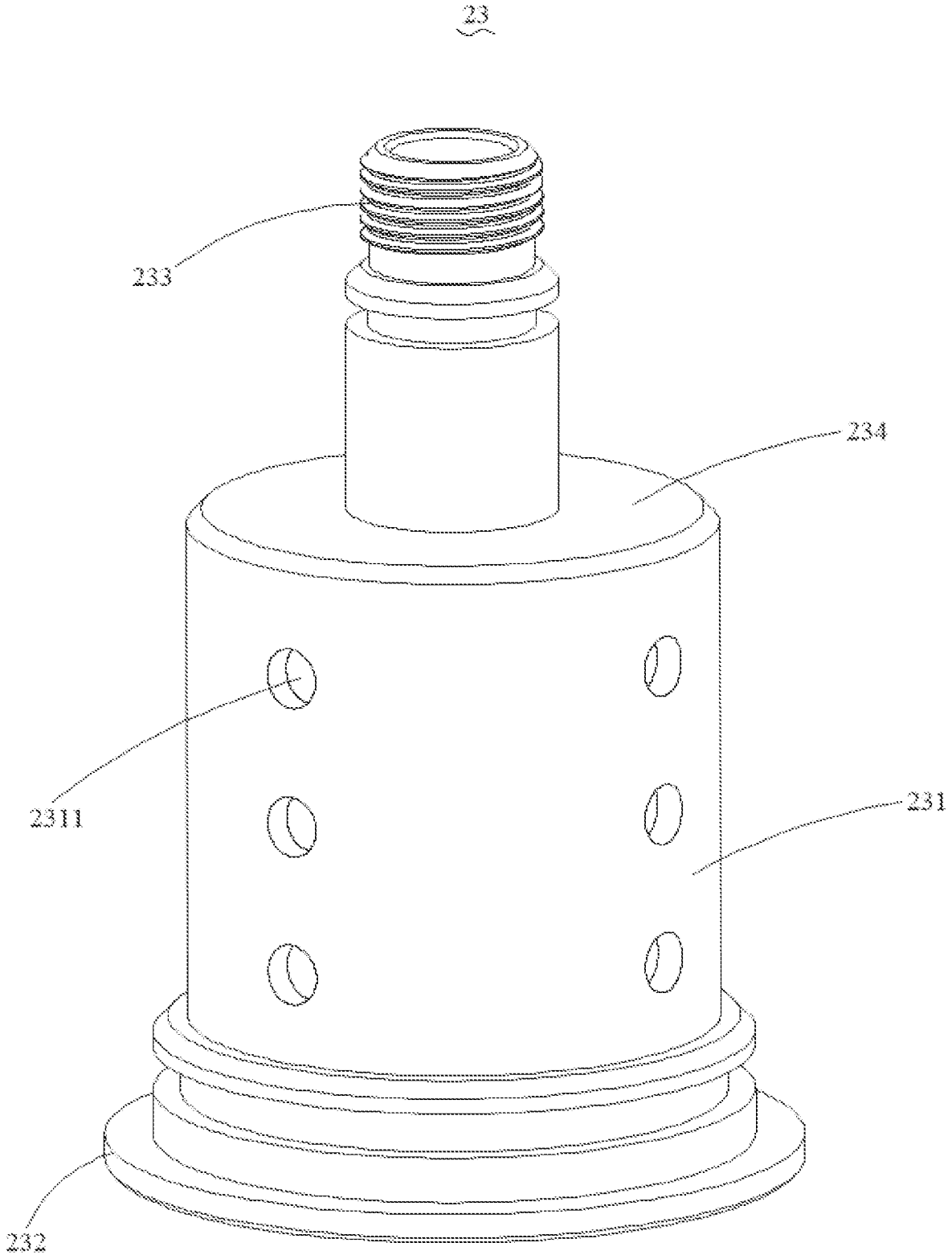
FIG. 4 is a schematic diagram of a sleeve according to one embodiment of the disclosure.

Referring to FIGS. 2 to 4, the main body 231 comprises a plurality of second holes 2311; and the main body is disposed correspondingly to the atomizing core. The e-liquid flows from the cavity 24 through the plurality of second holes into the sleeve 23, improving the speed of e-liquid accumulating around the first surface 211. Alternatively, the main body 231 comprises a material permeable to the e-liquid instead of comprising holes 2311.

Referring to FIGS. 1 and 2, the atomizing assembly 2 further comprises a strip of cotton 25 disposed between the main body 231 and the atomizing core 21. The cotton 25 is configured to absorb and store e-liquid. The e-liquid is stored in the cotton 25 and heated by the atomizer 10, thereby generating large amount of smoke. Alternatively, the atomizer 10 comprises no cotton 25.

Referring to FIGS. 1, 2 and 4, the sleeve 23 further comprises a first end 232 and a second end 233. The main body 231 is disposed between the first end 232 and the second end 233. The housing 1 is connected to the first end. The atomization assembly 2 further comprises a base 26 comprising a plurality of air inlets 261. The plurality of air inlets 261 allows external gas to enter the atomizer 10 and drives the smoke into the user's mouth. In certain embodiments, the base 26 comprises four air inlets 261, while any number of the air inlets 261 may be used, including, but not limited to, 1, 2, 3, 4, or 5.

Referring to FIGS. 2 and 4, the sleeve 23 further comprises a fixing part 234 disposed between the second end 233 and the main body 231. One end of the atomizing core 21 is connected to the fixing part 234 and the other end of the atomizing core is connected to the base 26, which prevents the atomizing core 21 from becoming loose.

Preferably, the housing 1 is detachably connected to the sleeve 23. The atomizer 10 further comprises a first sealing ring 3 disposed at the joint between the housing 1 and the sleeve 23. The first sealing ring 3 is configured to seal the joint between the housing 1 and the sleeve 23, preventing leakage of the e-liquid.

The housing 1 comprises glass, non-metallic ceramics, crystal, or agate. The materials withstand high temperatures and therefore prolong the service life of the housing 1. The amount of e-liquid left in the cavity 24 may also be seen through the transparent materials. In certain embodiments, the housing 1 comprises a non-transparent material, or part of the housing comprises a transparent part and the other part comprises a non-transparent part.

Figure 5:
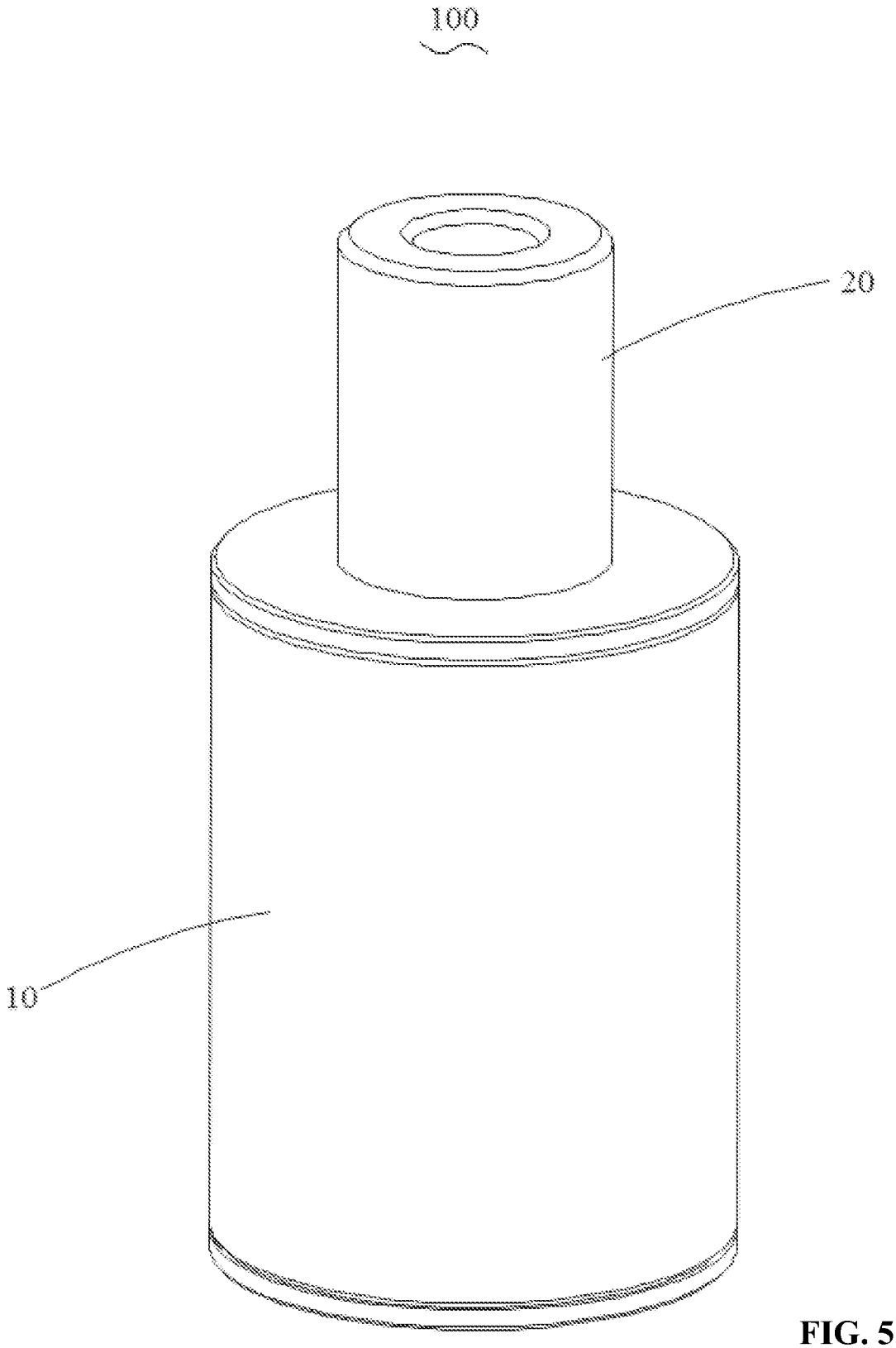
FIG. 5 is a schematic diagram of an e-cigarette assembly according to one embodiment of the disclosure.
Figure 6:
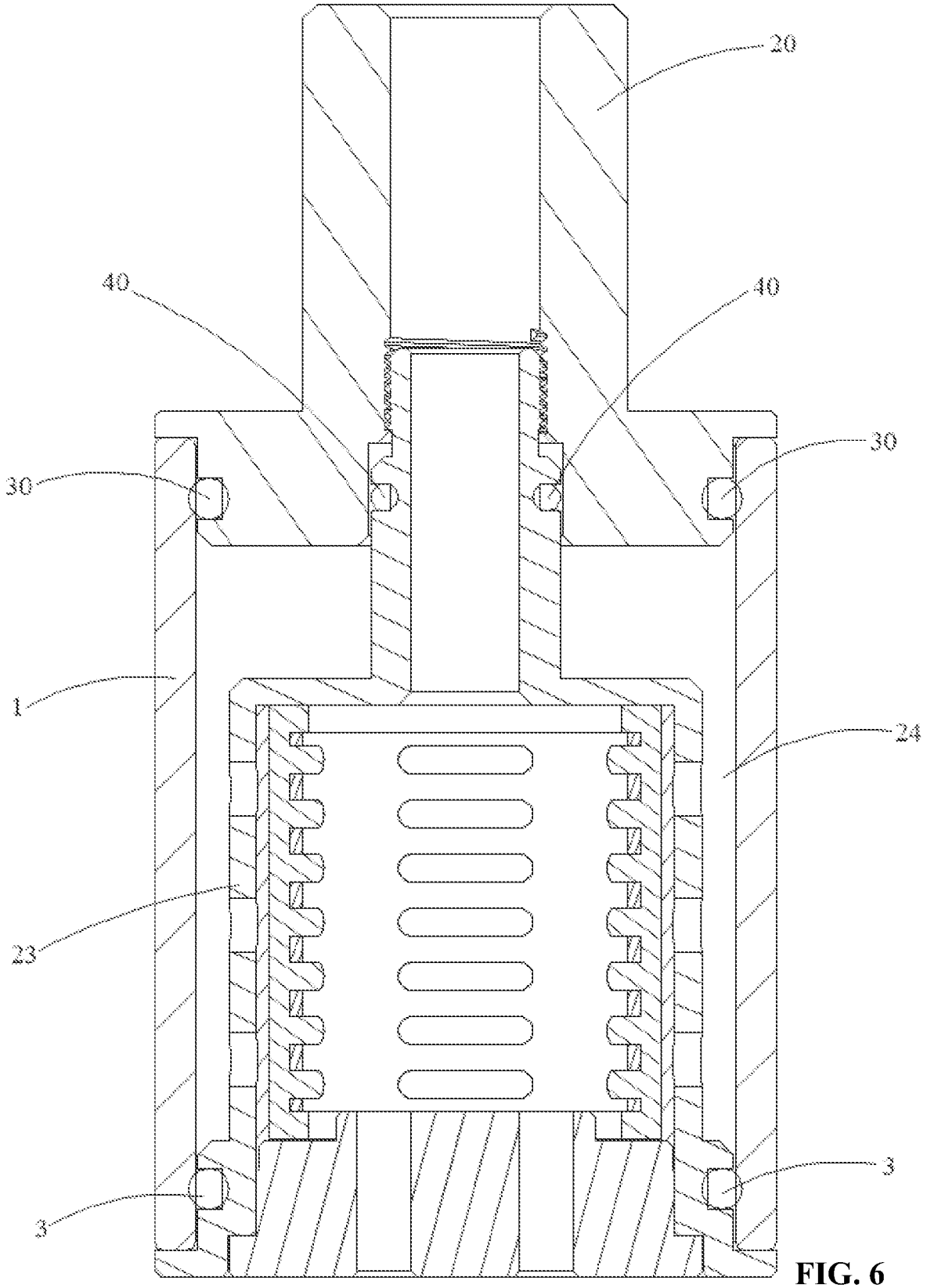
FIG. 6 is a cross section side view of an e-cigarette assembly according to one embodiment of the disclosure.

Referring to FIGS. 5 and 6, the disclosure further provides an e-cigarette assembly 100 comprising the mouthpiece 20 and the atomizer 10. The mouthpiece 20 is detachably connected to the housing 1 and the sleeve 23. The cavity 24 is covered with the mouthpiece 20, which prevents the e-liquid leaking from the cavity 24. The mouthpiece 20 is detachably connected to the sleeve 23. When the e-liquid runs out, the mouthpiece 20 is removed to open the cavity 24, and the e-liquid is added to the cavity 24. In certain embodiments, the mouthpiece 20 is connected to the sleeve 23 by a thread, a clamp slot, or a snap-fit.

Preferably, the e-cigarette assembly 100 further comprises a second sealing ring 30 disposed at the joint between the mouthpiece 20 and the housing 1. The second sealing ring 30 is configured to seal the joint between the mouthpiece 20 and the housing 1, preventing leakage of the e-liquid.

Preferably, the e-cigarette assembly 100 further comprises a third sealing ring 40 disposed at the joint between the mouthpiece 20 and the sleeve 23. The second sealing ring 30 is configured to seal the joint between the mouthpiece 20 and the sleeve 23, preventing leakage of the e-liquid.

Figure 7:
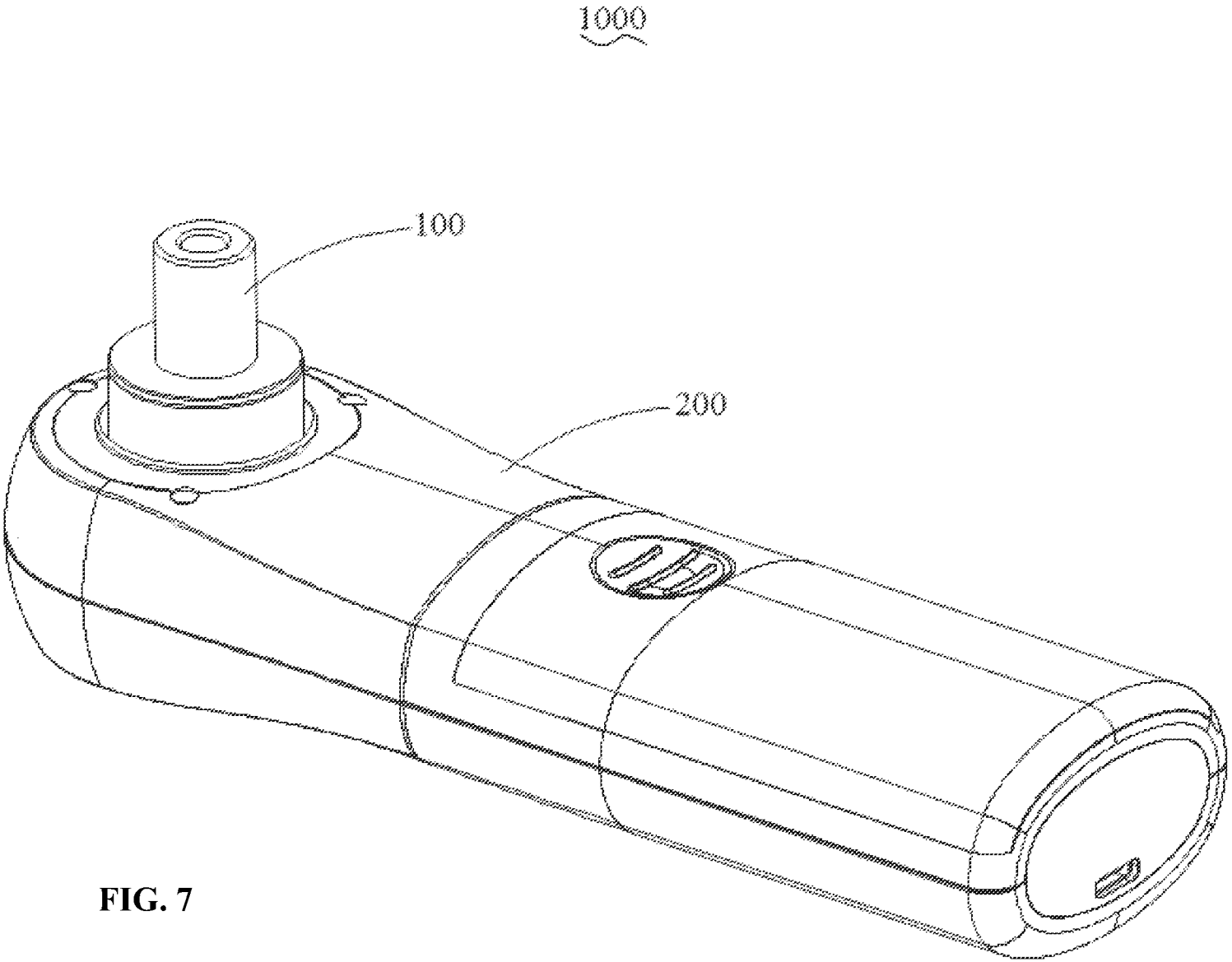
FIG. 7 is a schematic diagram of an e-cigarette according to one embodiment of the disclosure.
Figure 8:
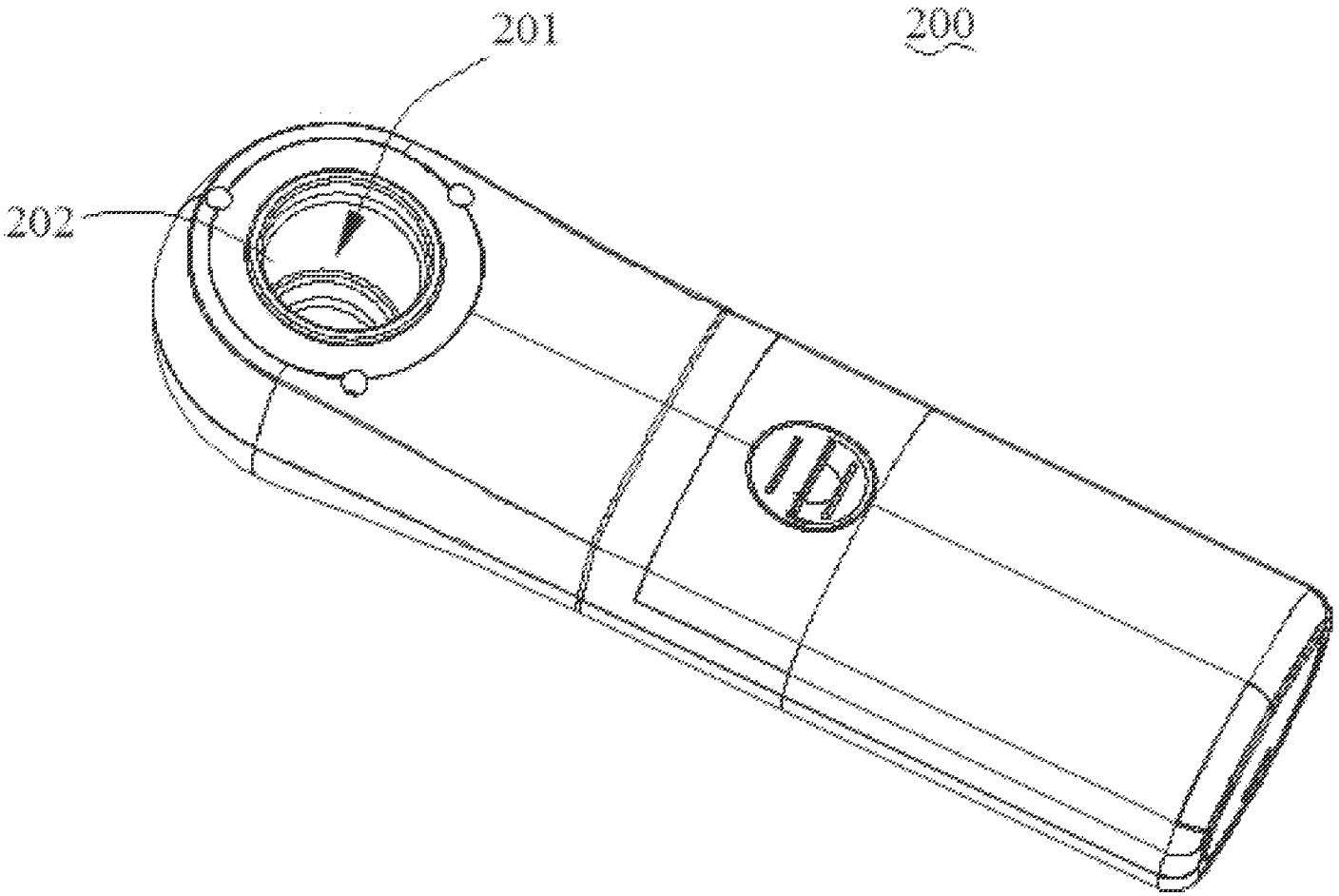
FIG. 8 is a schematic diagram of a high-frequency heater viewed from an angle according to one embodiment of the disclosure.
Figure 9:
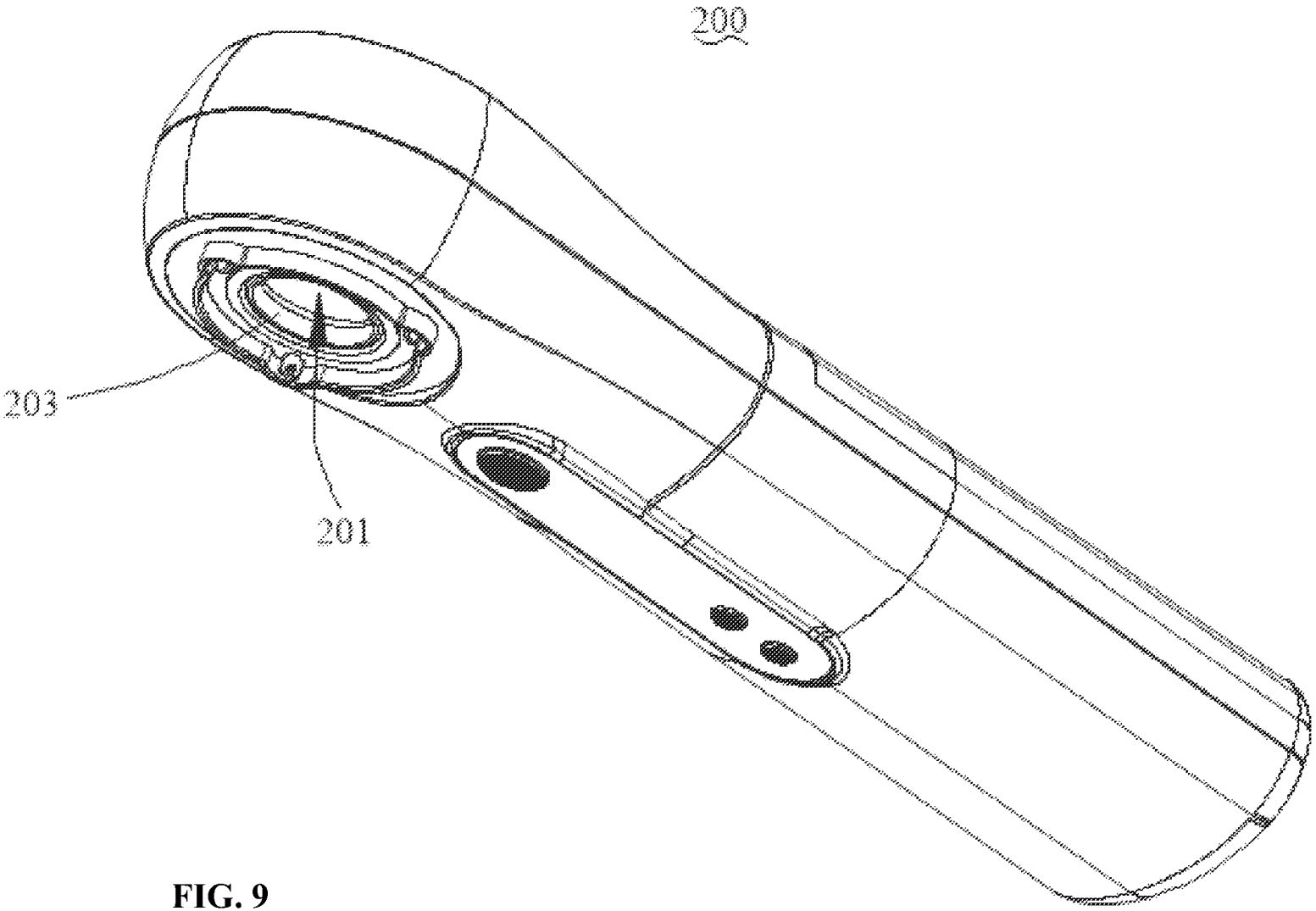
FIG. 9 is a schematic diagram of a high-frequency heater viewed from another angle according to one embodiment of the disclosure.

Referring to FIGS. 7 - 9, the disclosure further provides an e-cigarette 1000 comprising the high-frequency heater 200 and the e-cigarette assembly 100. The high-frequency heater 200 comprises a through hole 201, a first opening 202, and a second opening 203. The first opening 202 and the second opening 203 are opposite to each other and communicate with the through hole 201. The e-cigarette assembly 100 is detachably disposed in the through hole 201. The high-frequency heater 200 comprises an induction coil (not shown) and a control circuit (not shown). The control circuit is used to control the energization of the induction coil. In certain embodiments, the high-frequency heater 200 comprises the through hole comprising an inner wall (not shown). The induction coil surrounds the inner wall. After the control circuit energizes the high-frequency heater 200, an alternating current is generated and passes through the induction coil, creating a varying alternating magnetic field. The heating element 22 of the e-cigarette assembly 100 is disposed in the through hole and heated by eddy currents generated by the varying alternating magnetic field. In certain embodiments, the e-cigarette assembly 100 is passed through the first opening 202 and disposed in the through hole 201. When the user inhales smoke through the mouthpiece 20, the external air enters the e-cigarette assembly 100 through the second opening 203 and the plurality of air inlets 261. In certain embodiments, the e-cigarette assembly 100 and the high-frequency heater 200 are separately disposed, which enables flexible use and convenient carrying of the e-cigarette 1000. When the e-cigarette assembly 100 or the high-frequency heater 200 fails, only a malfunctioning component is replaced other than the whole e-cigarette 1000, thereby saving costs. In certain embodiments, the e-liquid in the e-cigarette 1000 is heated by the heating element 22 and atomized into smoke at high temperature, indicating that the heating element 22 can be heated directly by the eddy currents instead of using batteries. Compared to batteries, the high-frequency heating increases the heating power, leading to rapid atomization of the e-liquid and an increase in the amount of smoke produced. In the atomizer 10 of the e-cigarette 1000, the batteries are not needed, which prevents a short circuit caused by e-liquid leakage.

Figure 10:
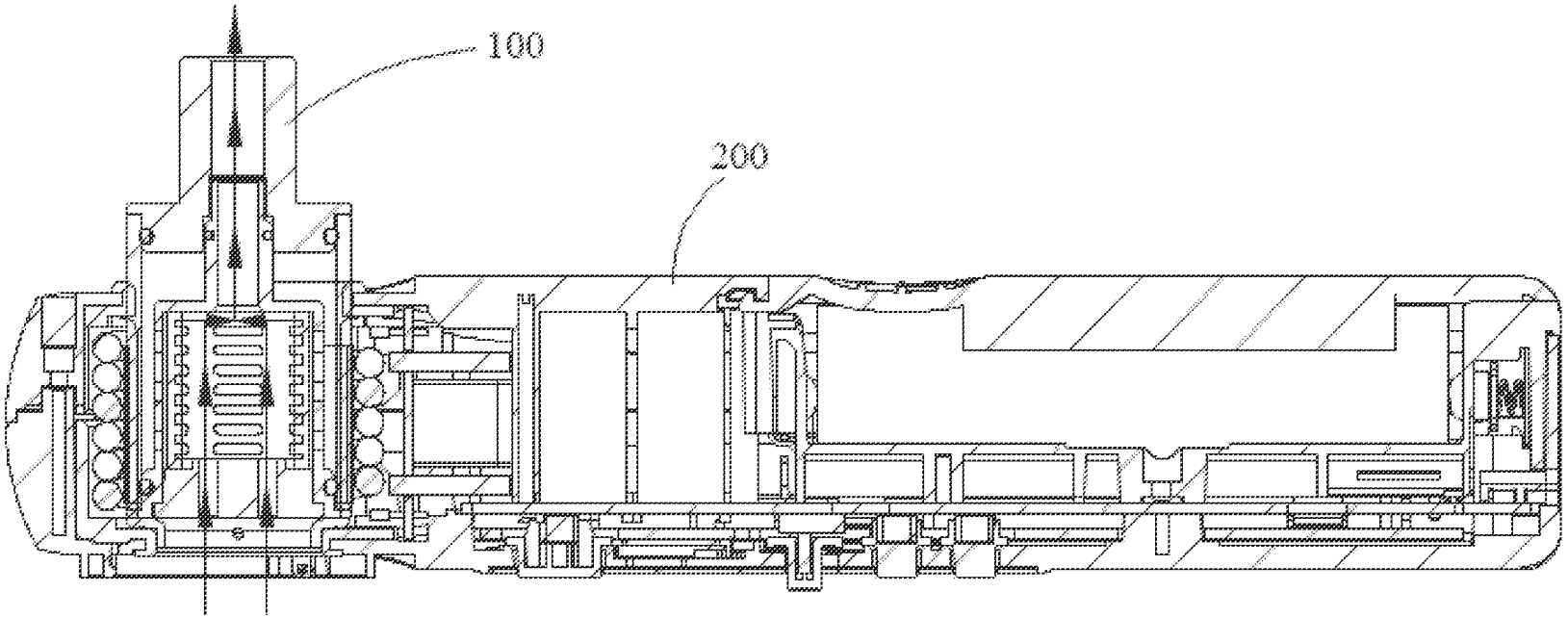
FIG. 10 is a schematic diagram of the flow of external air and smoke according to one embodiment of the disclosure.

Referring to FIG. 10, in certain embodiments, when the user inhales smoke, the external air flows through the second opening 203, the plurality of air inlets 261 and the inner cavity of the heating element 22, drives the smoke to pass through the inner cavity of the first end 232, the inner cavity of the first end 232 and the gas passage of the mouthpiece 20, and then is inhaled by the user. In FIG. 10, the arrow shows the direction of flow of the external air and the smoke.

It will be obvious to those skilled in the art that changes and modifications may be made, and therefore, the aim in the appended claims is to cover all such changes and modifications.

What is claimed is:

1. An atomizer, comprising:

1) a housing; and 2) an atomization assembly disposed in the housing;

wherein:

the atomization assembly comprises an atomizing core, a heating element, and a sleeve;

the sleeve is connected to and enclosed by the housing, and a cavity is formed between the sleeve and the housing;

the atomizing core and the heating element are fixedly disposed in the sleeve;

the atomizing core comprises a first surface and a second surface which are disposed back to back;

the sleeve comprises a main body through which e-liquid flows from the cavity into the sleeve and accumulates around the first surface of the atomizing core; and the heating element is surrounded by the second surface of the atomizing core.

2. The atomizer of claim 1, wherein the atomizing core is in the shape of a hollow cylinder; and the heating element is disposed in the atomizing core.

3. The atomizer of claim 2, wherein a cross-section of the atomizing core is circular, elliptical, triangular, quadrilateral, pentagonal, hexagonal, or heptagonal.

4. The atomizer of claim 2, wherein the heating element is in the shape of a hollow cylinder; and a shape of the cross-section of the heating element is the same as that of the cross-section of the atomizing core.

5. The atomizer of claim 4, wherein the heating element comprises a plurality of first holes; the atomizing core further comprises a plurality of protrusions that respectively matches the plurality of first holes and is disposed on the second surface; the plurality of protrusions is inserted into the plurality of first holes so that the heating element is fixedly disposed on the atomizing core.

6. The atomizer of claim 4, wherein the main body comprises a plurality of second holes; and the main body is disposed correspondingly to the atomizing core.

7. The atomizer of claim 6, wherein the atomizing assembly further comprises a strip of cotton disposed between the main body and the atomizing core.

8. The atomizer of claim 4, wherein the sleeve further comprises a first end and a second end; the main body is disposed between the first end and the second end; the housing is connected to the first end; the atomization assembly further comprises a base comprising a plurality of air inlets; and the plurality of air inlets allows external gas to enter the atomizer.

9. The atomizer of claim 8, wherein the sleeve further comprises a fixing part disposed between the second end and the main body; one end of the atomizing core is connected to the fixing part and the other end of the atomizing core is connected to the base.

10. The atomizer of claim 4, wherein the housing is detachably connected to the sleeve; the atomizer further comprises a first sealing ring disposed at the joint between the housing and the sleeve.

11. The atomizer of claim 4, wherein the housing comprises glass, non-metallic ceramics, crystal, or agate; and/or the atomizing core comprises a porous material.

12. An e-cigarette assembly, comprising a mouthpiece and the atomizer of claim 1, wherein the mouthpiece is detachably connected to the housing and the sleeve.

13. The e-cigarette assembly of claim 12, wherein the e-cigarette assembly further comprises a second sealing ring disposed at a joint between the mouthpiece and the housing; and/or the e-cigarette assembly further comprises a third sealing ring disposed at a joint between the mouthpiece and the sleeve.

14. An electronic cigarette, comprising a high-frequency heater and the e-cigarette assembly of claim 12, wherein the high-frequency heater comprises a through hole, a first opening, and a second opening; the first opening and the second opening are opposite to each other and communicate with the through hole; and the e-cigarette assembly is detachably disposed in the through hole.

15. The electronic cigarette of claim 14, wherein the high-frequency heater comprises an induction coil and a control circuit.

* * * * *